US006223921B1

(12) United States Patent
Huang

(10) Patent No.: US 6,223,921 B1
(45) Date of Patent: May 1, 2001

(54) EYE SHADOW CASE

(76) Inventor: Mei-Yun Huang, 58, Ma Yuan West St., Taichung (TW)

( * ) Notice: Subject to any disclaimer, the term of this patent is extended or adjusted under 35 U.S.C. 154(b) by 0 days.

(21) Appl. No.: 09/640,114

(22) Filed: Aug. 14, 2000

(51) Int. Cl.[7] ..... B65D 9/00
(52) U.S. Cl. ..... 220/4.27; 220/23.88; 132/295
(58) Field of Search ..... 220/4.26, 4.27, 220/23.88, 475; 132/295, 294

(56) References Cited

U.S. PATENT DOCUMENTS 1,703,340 * 2/1929 Greennan .
2,507,951 * 5/1950 Barnes ..... 220/4.26
3,224,655 * 12/1965 Buchanan et al. .
3,951,079 * 4/1976 Tolleson ..... 220/4.26
4,311,237 * 1/1982 Hayes ..... 220/4.03
4,815,483 * 3/1989 DuGreenizr et al. ..... 220/4.27
5,346,091 * 9/1994 Hsu ..... 220/4.27
5,370,255 * 12/1994 Yang ..... 220/4.27
5,799,787 * 9/1998 Talbot ..... 220/4.27
6,145,515 * 11/2000 Wu ..... 220/4.27

* cited by examiner

*Primary Examiner*—Joseph M. Moy

(57) ABSTRACT

An eye shadow case has a base seat, a plurality of inner casings, a shaft, and a cover. The cover receives the base seat, the inner casings, and the shaft. The base seat has a socket receiving the shaft. The shaft has a plurality of spaced disks, a plurality of spaced rods, and a top block. Each disk has a corrugation periphery. Each inner casing has an inner interior, a first C-shaped collar enclosing the respective disk, and a second C-shaped collar enclosing the respective rod. Each first C-shaped collar has an inner corrugation periphery and a first notch. Each second C-shaped collar has a second notch.

2 Claims, 7 Drawing Sheets

EYE SHADOW CASE

BACKGROUND OF THE INVENTION

The present invention relates to an eye shadow case. More particularly, the present invention relates to an eye shadow case which has a plurality of inner casings to be rotated easily.

A conventional eye shadow case has a plurality of inner casings. However, the upward inner casing should be rotated first and other inner casings should be rotated one by one in order.

SUMMARY OF THE INVENTION

An object of the present invention is to provide an eye shadow case which has a plurality of inner casings to be rotated easily.

Accordingly, an eye shadow case comprises a base seat, a plurality of inner casings, a shaft, and a cover. The cover receives the base seat, the inner casings, and the shaft. The base seat has an upper click portion, a hollow interior, and a socket receiving the shaft. The shaft has a plurality of spaced disks, a plurality of spaced rods, a top block, and a through hole. Each disk has a corrugation periphery. Each inner casing has an inner interior, a first C-shaped collar enclosing the respective disk, and a second C-shaped collar enclosing the respective rod. Each first C-shaped collar has an inner corrugation periphery and a first notch. Each second C-shaped collar has a second notch.

DETAILED DESCRIPTION OF THE INVENTION

Figure 1:
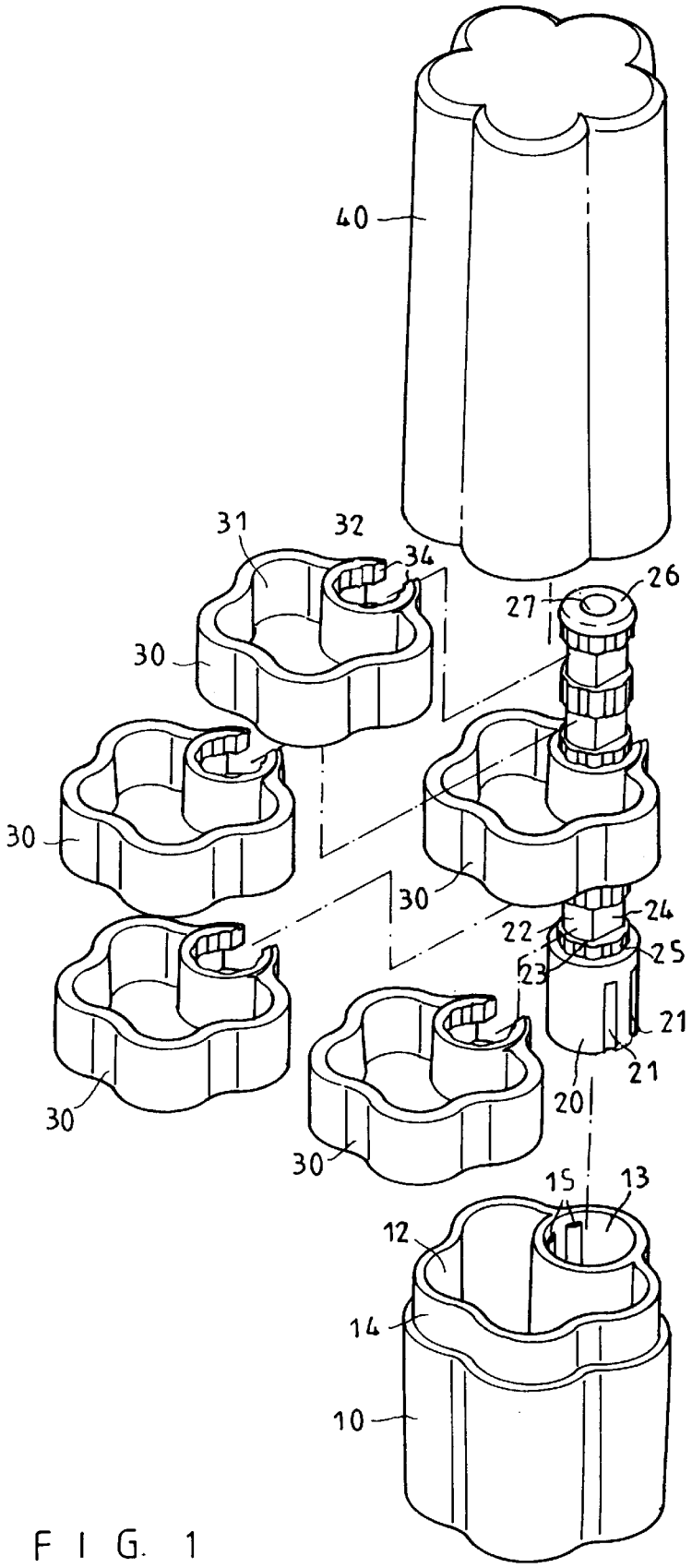
FIG. 1 is a perspective exploded view of an eye shadow case of a preferred embodiment in accordance with the present invention.
Figure 1A:
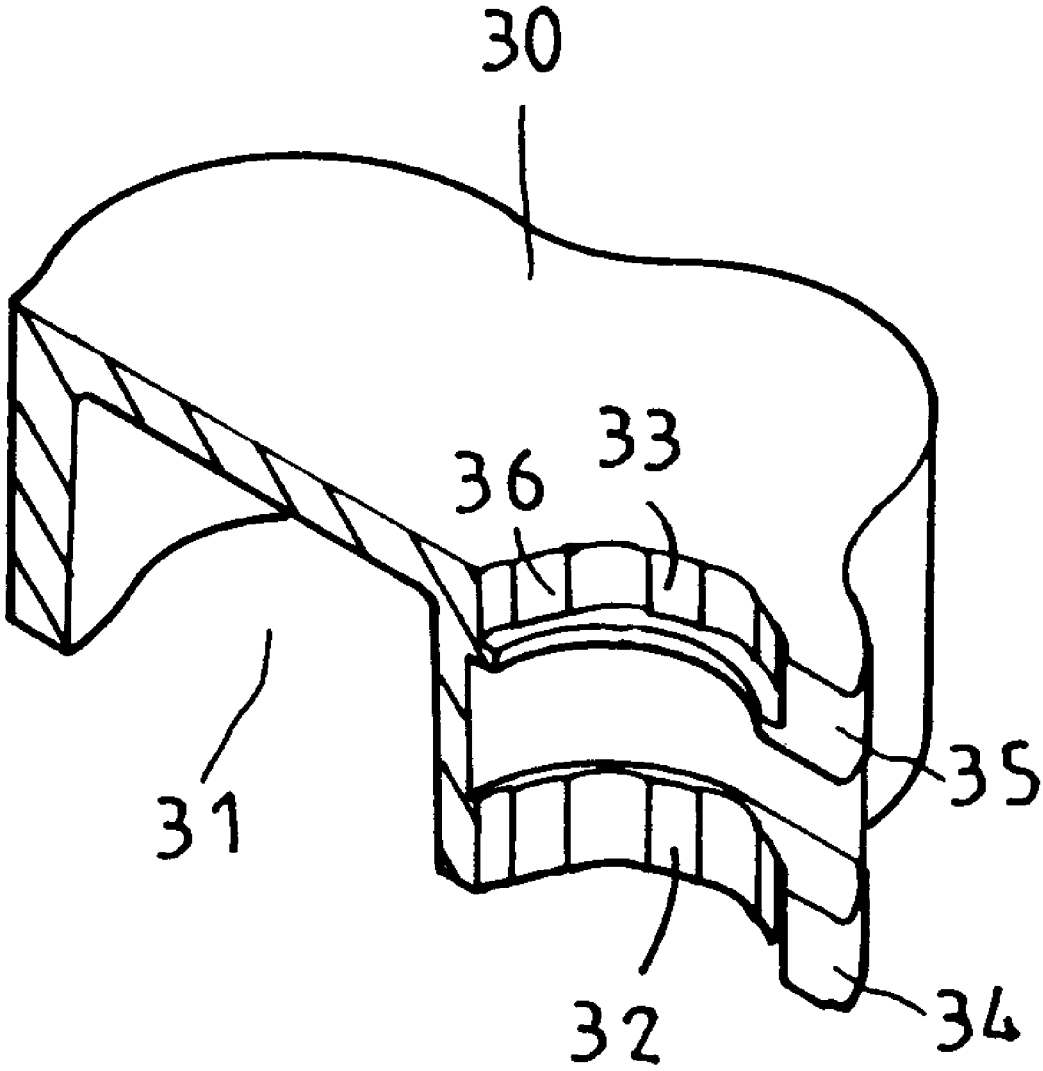
FIG. 1A is a partially sectional view of an inner casing of a preferred embodiment in accordance with the present invention.
Figure 2:
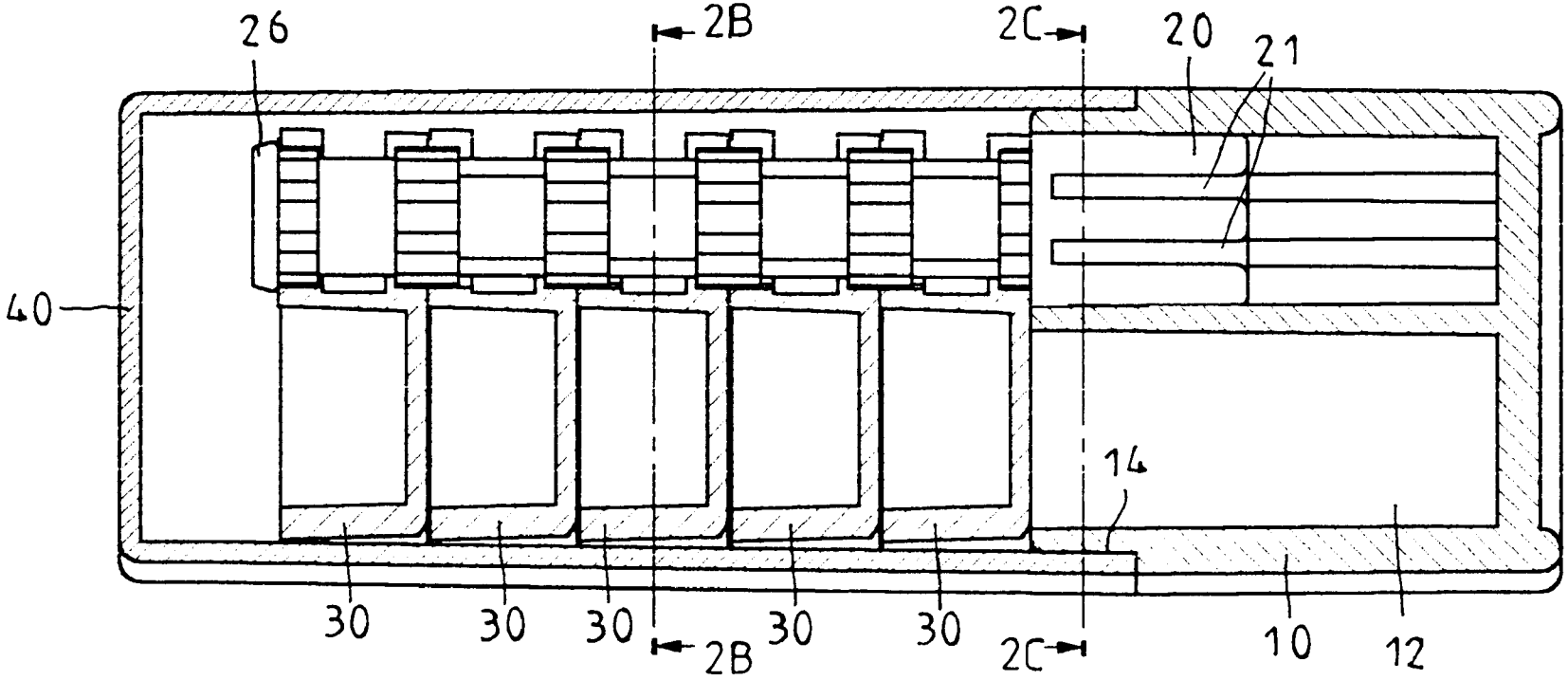
FIG. 2 is a sectional assembly view of an eye shadow case of a preferred embodiment in accordance with the present invention.
Figure 2A:
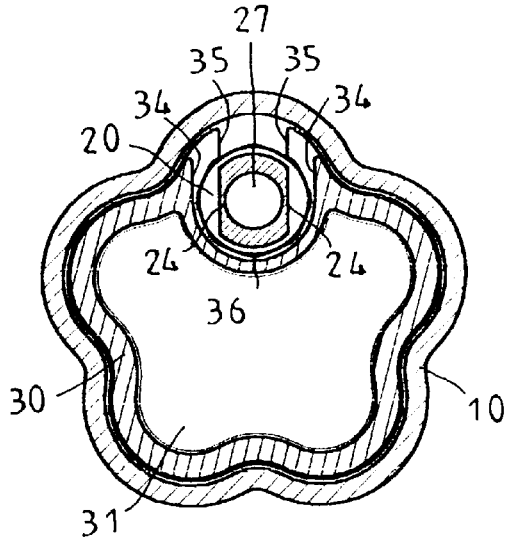
FIG. 2A is a sectional view taken along line 2B—2B in FIG. 2.
Figure 2B:
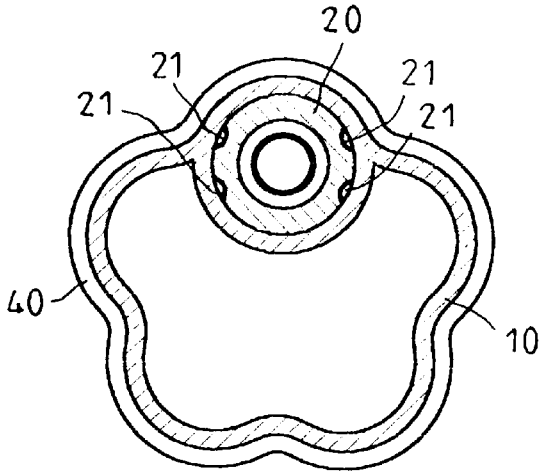
FIG. 2B is a sectional view taken along line 2C—2C in FIG. 2.
Figure 3:
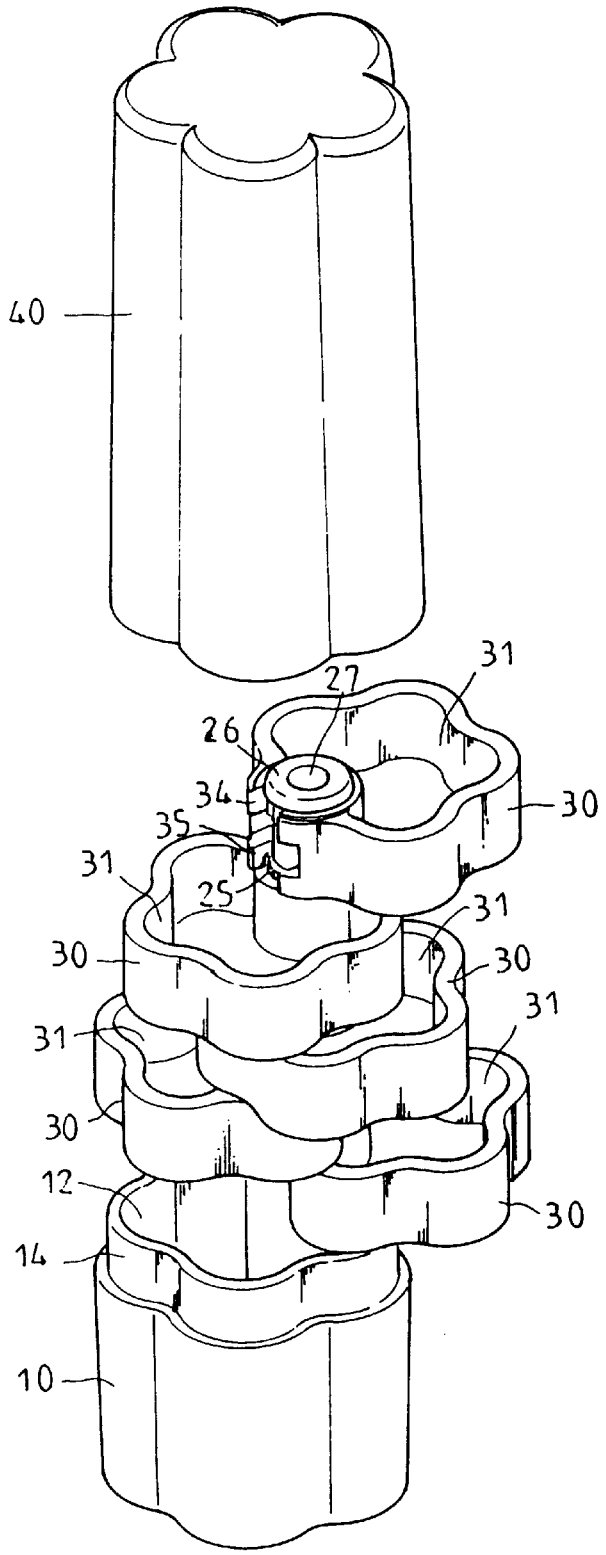
FIG. 3 is a schematic view illustrating an operation of an eye shadow case of a preferred embodiment in accordance with the present invention.
Figure 4:
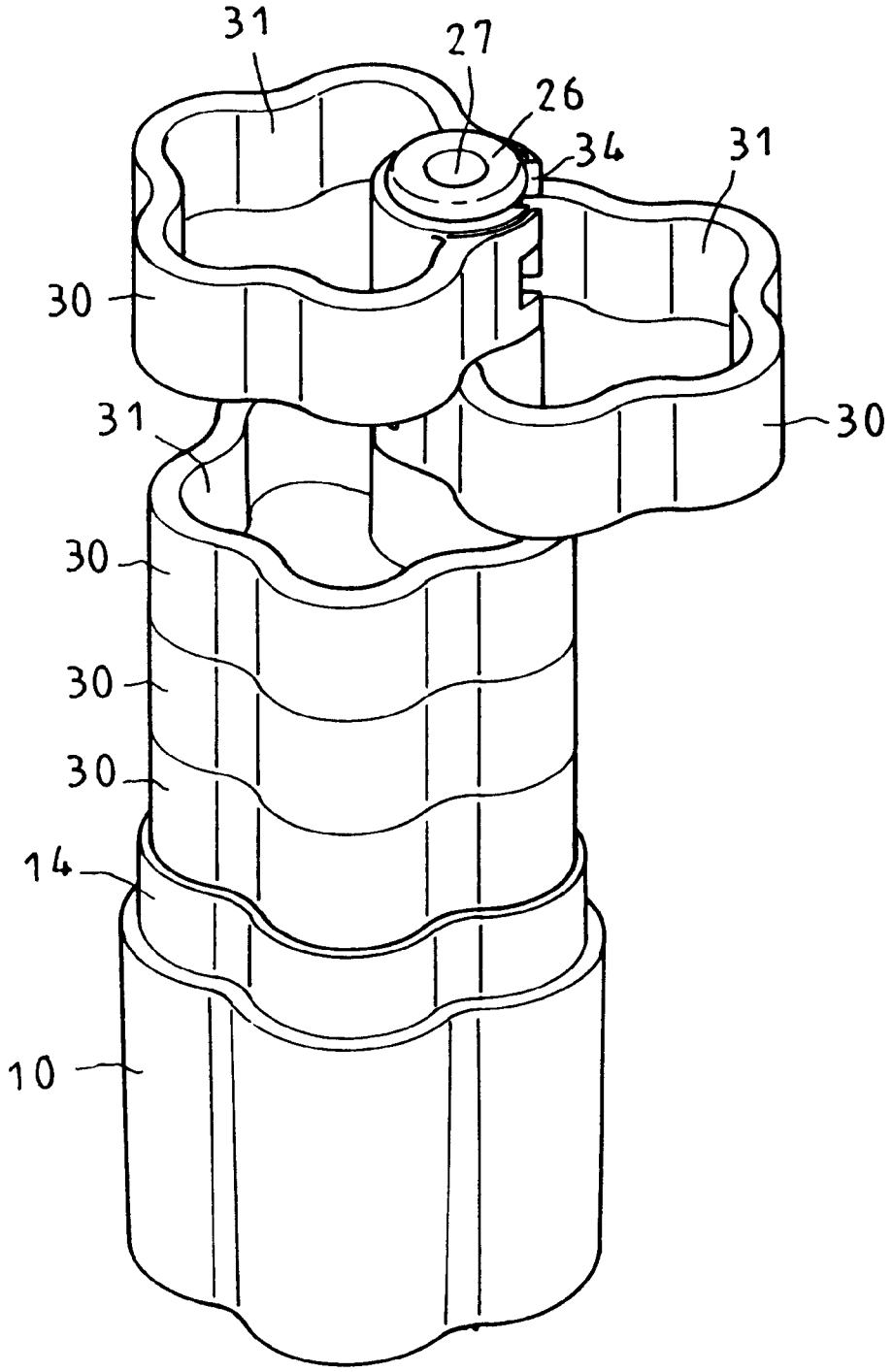
FIG. 4 is a schematic view illustrating another operation of an eye shadow case of a preferred embodiment in accordance with the present invention.
Figure 5:
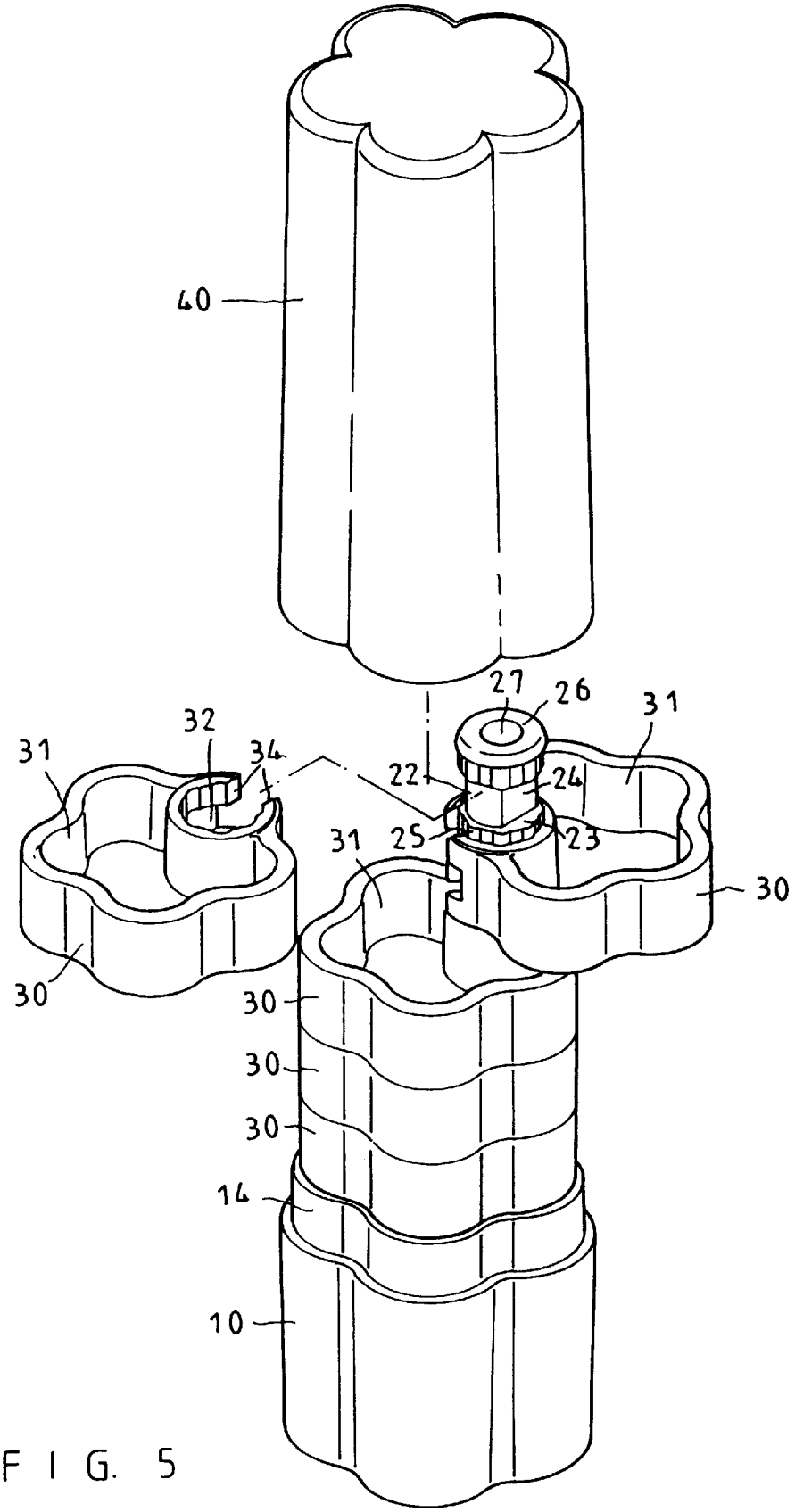
FIG. 5 is a partially perspective exploded View of an eye shadow case of a preferred embodiment in accordance with the present invention.

Referring to FIGS. 1 to 5, an eye shadow case comprises a base seat 10, a plurality of inner casings 30, a shaft 20, and a cover 40.

The cover 40 receives the base seat 10, the inner casings 30, and the shaft 20.

The base seat 10 has an upper click portion 14, a hollow interior 12, and a socket 13 receiving the shaft 20. Two positioning bars 15 are disposed in the socket 13.

The shaft 20 has two lower positioning recesses 21 receiving the positioning bars 15, a plurality of spaced disks 23, a plurality of spaced rods 22, a top block 26, and a through hole 27.

Each of the rods 22 has four faces 24.

Each of the disks 23 has a corrugation periphery 25.

Each of the inner casings 30 has an inner interior 31, a first C-shaped collar 33 enclosing the respective disk 23, and a second C-shaped collar 32 enclosing the respective rod 22.

The first C-shaped collar 33 has an inner corrugation periphery 36 and a first notch 35.

The second C-shaped collar 32 has a second notch 34.

Each of the inner casings 30 will be rotated individually.

The present invention is not limited to the above embodiment but various modification thereof may be made. Furthermore, various changes in form and detail may be made without departing from the scope of the preset invention.

I claim:

1. An eye shadow case comprises:

a base seat, a plurality of inner casings, a shaft, and a cover, the cover receiving the base seat, the inner casings, and the shaft, the base seat having an upper click portion, a hollow interior, and a socket receiving the shaft, the shaft having a plurality of spaced disks, a plurality of spaced rods, and a top block, each said disk having a corrugation periphery, each said inner casing having an inner interior, a first C-shaped collar enclosing the respective disk, and a second C-shaped collar enclosing the respective rod, each said first C-shaped collar having an inner corrugation periphery and a first notch, and each second C-shaped collar having a second notch.

2. The eye shadow case as claimed in claim 1, wherein two positioning bars are disposed in the socket, and the shaft has two lower positioning recesses receiving the positioning bars.

* * * * *